United States Patent [19]

Filter et al.

[11] Patent Number: 4,674,697

[45] Date of Patent: Jun. 23, 1987

[54] SPLICING AND THREADING DEVICE FOR STRIPS OF PAPER, ESPECIALLY FOR STRIPS OF CIGARETTE PAPER

[75] Inventors: Goetz Filter, Himmelkron; Gisbert Jaeckel, Hanover, both of Fed. Rep. of Germany

[73] Assignee: BAT Cigarettenfabriken GmbH, Hamburg, Fed. Rep. of Germany

[21] Appl. No.: 854,834

[22] Filed: Apr. 23, 1986

[30] Foreign Application Priority Data

Apr. 27, 1985 [DE] Fed. Rep. of Germany ..... 3515643

[51] Int. Cl.[4] ..... B65H 19/16; B65H 21/00; B65H 19/18

[52] U.S. Cl. ..... 242/58.1; 242/58.3; 242/58.4; 242/78.8

[58] Field of Search ..... 242/58.1–58.5, 242/78.8

[56] References Cited

U.S. PATENT DOCUMENTS

| | | | |
|---|---|---|---|
| 3,030,043 | 4/1962 | Pinkham | 242/58.3 |
| 3,061,220 | 10/1962 | Gagg et al. | 242/58.4 |
| 3,089,661 | 5/1963 | Phillips . | |
| 3,252,671 | 5/1966 | Phillips et al. | 242/58.1 |
| 3,730,811 | 5/1973 | Wendt | 242/58.4 X |
| 3,925,131 | 12/1975 | Krause | 242/58.3 X |
| 4,131,501 | 12/1978 | Bottcher et al. | 242/58.3 X |
| 4,540,459 | 9/1985 | Stewart et al. | 242/58.1 X |

FOREIGN PATENT DOCUMENTS

| | | |
|---|---|---|
| 2938685 | 6/1980 | Fed. Rep. of Germany . |
| 3000723 | 9/1981 | Fed. Rep. of Germany . |
| 3402022 | 1/1985 | Fed. Rep. of Germany . |

*Primary Examiner*—Donald Watkins

[57] ABSTRACT

In a device for splicing the beginning of a paper strip wound on a new reel, especially a cigarette paper strip, to the end of the paper strip on an off-winding reel. The lead of the paper strip of the new reel is picked up by a gripping mechanism and is fed to a stamping device where the strips are connected by a grid of uniform pyramids. The device facilitates completely automatic reel replacement and gives a very tight but still very flexible connection of the paper strips.

13 Claims, 4 Drawing Figures

SPLICING AND THREADING DEVICE FOR STRIPS OF PAPER, ESPECIALLY FOR STRIPS OF CIGARETTE PAPER

FIELD OF THE INVENTION

The present invention relates to a device for splicing the beginning of a paper strip wound on a new reel to the end of the strip of paper on an off-winding reel, especially strips of cigarette paper.

BACKGROUND OF THE INVENTION

In the manufacture of cigarettes, a rope of tobacco is customarily formed and is sheathed with cigarette paper. The paper is unwound from a reel in the cigarette making machine. Traditionally, the off-winding reel is located on the rope machine component of the cigarette machine. Because of the extraordinary great quantity of cigarettes manufactured per time unit, it is necessary to place a new reel on the cigarette machine about every 10 to 14 minutes.

The beginning of the paper strip of a new reel is connected with the end of the paper strip of the off-winding reel such that the feed of the paper strip to the cigarette machine is not interrupted. This uninterrupted operation is obtained by accelerating the off-winding reel shortly before reaching the end of the paper strip of the off-winding reel to lay out a certain spare length of cigarette paper in a buffer zone. The cigarette paper is then withdrawn from the buffer zone while connecting the new reel with the old reel and when an end portion of the cigarette paper is in a rest or stationary state.

The connection of the paper strip of the new reel to the paper strip end of the old reel usually occurs with the aid of a strip of adhesive film. The adhesive film can be detected later in the cigarette machine and can be removed. Manual devices are required for application of the adhesive strip to the paper ends, which devices cannot be automatized without great difficulty. This also requires a cyclic operation of the cigarette machine. German OS No. 34 02 022 discloses an automatic adhesive strip feed which requires additional automatic devices (reel feed).

Attempts have been made to provide a completely automatic feed of a paper strip lead from a new reel into the cigarette machine. Avoiding the use of an adhesive strip has also and especially been sought. U.S. Pat. No. 3,089,661 discloses connecting two paper strips to each other by a stamping. This can be attained either by milling with a transversally fluted roller or by stamping with a roughened punch. It has been shown that this connection gives two paper strips of sufficient strength. However, as a result of the stamping process, the connection between the two paper strips is so unflexible that damages arise in the tobacco rope machine. Flexibility of the paper strip is attained with milling solely in a transverse direction. However, this transverse milling makes the sheathing of the cigarette rope with the paper strip difficult. Stamping with a roughened surface gives rigidity in both directions, so that, along with the difficulty of sheathing the cigarette rope, still other problems arise with the manipulation of the paper strip. These connection processes therefore could not possibly be carried out.

For completely automatic connection of two paper strips from an off-winding reel and a new reel, it is further required to feed in the paper strip lead of the new reel to the paper strip of the off-winding reel. German OS No. 29 38 635 teaches separation of the protective strip or the first layer of the new reel by a cutting tool, followed by conduction of the then freed paper strip lead over a suction and conveyance device to the paper strip of the off-winding reel. The new reel, however, cannot be cut with adequate precision such that only one single layer of the paper strip lead is cut. This device is complicated and apt to break down.

SUMMARY OF THE INVENTION

Accordingly, objects of the present invention are to provide a device for splicing the beginning of the paper strip of a new reel to the end of the paper strip of the off-winding reel, wherein there is a secure grasp of the paper strip lead, a simple introduction of the paper strip to the splicing device and a secure, flexible connection of the two paper strips without use of adhesive strips.

The foregoing objects are basically obtained by a device for splicing one paper strip winding to an end portion of another paper strip winding, comprising new and off-winding reels, a splicing mechanism adjacent the off-winding reel, a gripping mechanism a cutting mechanism adjacent the splicing mechanism, a suction mechanism and a control for regulating operation. The new reel has a first paper strip wound on it with a first layer fastened to a second layer and with a lead portion unconnected with the second layer. The off-winding reel has a second paper strip on it with an end portion. The splicing mechanism receives the paper strips parallel to each other and stamps them together with stamping surfaces having a uniform pattern of projections at right angles to each other such that stamping occurs essentially only in planes extending in the paper strip movement direction. The gripping mechanism picks up the lead portion and conveys it through the splicing mechanism when open, and includes an arm engaging the lead portion. The cutting mechanism trims free ends of the paper strips. The suction mechanism receives and pulls the lead portion through the splicing mechanism.

According to the invention, the paper strip of a new reel is picked up by purely mechanical means following photoelectric detection and is guided to the splicing mechanism under the clamping effect of the gripping mechanism. The lead of the paper strip passes over a suction mechanism, which holds the paper strip until the new paper strip is connected with the end of the off-winding reel in the stamping device. The uniform grid dimensions of the splicing mechanism cause the stamp connection of the two paper strips to remain very flexible both in the direction of paper strip movement, and also in the lateral direction of the paper strips, such that no damages are caused in the rope machine. The excess paper strip ends are trimmed off directly following the stamping.

In one particular embodiment of the invention a special shape of the stamping device, parameters for improvement of the trimming of the excess paper ends, as well as the configuration of the conveyor device of the paper strips from a new reel to the stamping device are provided.

The device according to the invention permits complete automatic splicing of the paper strip lead of a new reel to the paper strip end of an off-winding reel. With simultaneous use of a completely automatic reel replacement device, such as disclosed in German OS No. 30 00 723.9, this entire component of cigarette production can also be completely automatically powered, so that cyclic operation in cigarette production can be completely deleted.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE PREFERRED EMBODIMENTS

Figure 1:
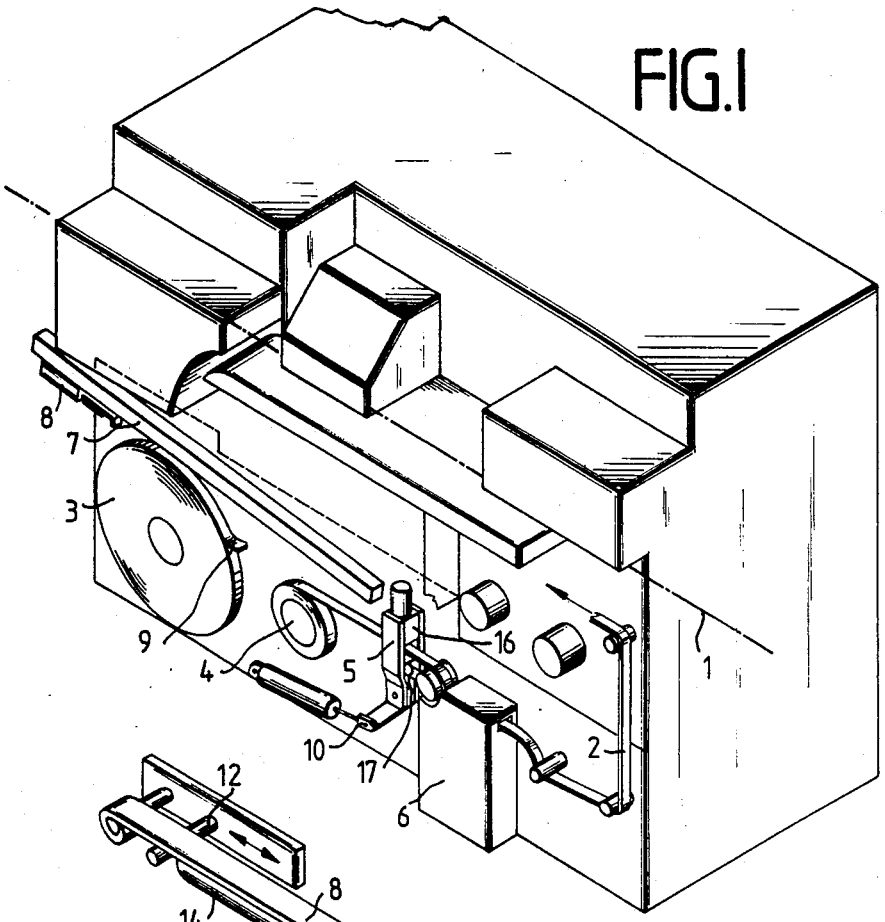
FIG. 1 is a simplified perspective view of a cigarette production machine according to a first embodiment of the present invention.

The machine shown in FIG. 1 shows the rope machine component of the cigarette machine. The rope of tobacco runs with its axis corresponding approximately to the broken line illustrating cigarette path 1. On the front of the machine, two reels, including a new reel 3 and an off-winding reel 4, are provided. The paper strip 2 runs from off-winding reel 4 through the splicing device 5, the buffer store 6 and over various guide rollers to tobacco rope 1, which rope is sheathed in a customary manner with cigarette paper strip 2. Above the two reels 3 and 4, a guide rail is directed toward a gripping mechanism 8. With the aid of gripping mechanism 8, paper strip lead 9 of new reel 3 can be picked up and conveyed along guide rail 7 through splicing device 5. Splicing device 5 includes a punch and a pressure stamp pressed against each other by a bent lever device or press 10.

The splicing process is carried out essentially in the following manner. When a diameter sensor detects that off-winding reel 4 is nearing the end of its paper strip, the reel rotational speed is increased by a certain degree producing an increased length of paper strip laid out in buffer store 6, with the same rope speed. Shortly before the end of the paper strip on off-winding reel 4, this end is held and the off-winding paper strip is then preselected for the application of a new paper strip. Meanwhile, paper strip lead 9 of the new reel is picked up by gripping meahcnism 8 and is conducted along guide rail 7 to splicing device 5. Paper strip lead 9 is conducted through the splicing device and is picked up behind or downstream of splicing device 5 by a suction device. Following release of paper lead strip 9 from the gripping mechanism, the suction device sucks the paper strip lead along until the end of pre-laid protection strip is reached and is detected by a photoelectric arrangement.

At this movement, new reel 3 is likewise stopped so that both paper strips now lie parallel to each other in rest states. The bent lever press 10 is then operated, and the two paper strips are pressed against each other and connected tightly with each other. Directly thereafter, the excess paper strip ends of the off-winding reel and the new reel are trimmed off. The paper strip can then be pulled further from new reel 3. Reel 3 is accelerated for that purpose, and still another part of the paper strip runs into the buffer store, which meanwhile has been almost completely emptied. Following complete emptying of a buffer store 6, new reel 3 reaches a peripheral speed corresponding to the pulling speed of the cigarette making machine. In a known manner then, the off-winding reel is thrown out and new reel 3 is set in its place.

Figure 2:
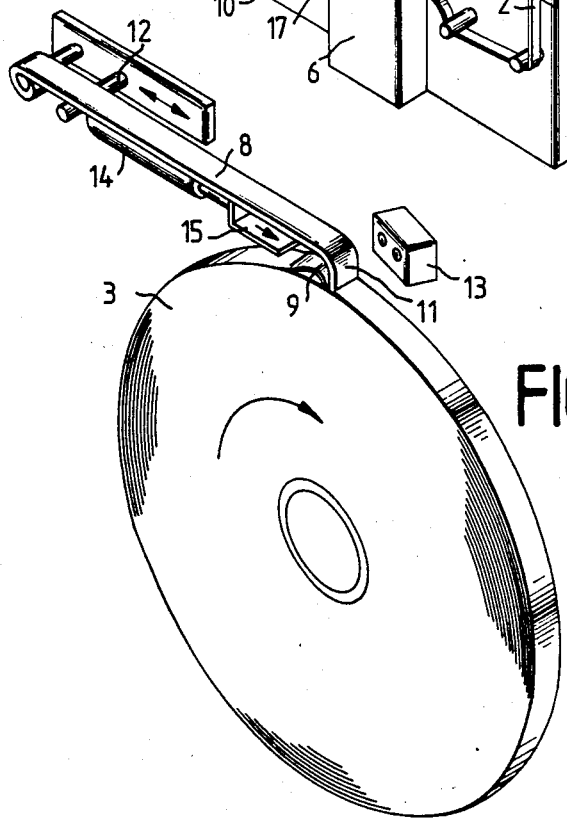
FIG. 2 is a diagrammatic perspective view of the gripping mechanism of the machine of FIG. 1.

FIG. 2 shows an enlarged partial view of the gripping system for picking up the paper strip from new reel 3. The gripping mechanism includes a gripping arm 8 slidable along guide rail 7, which gripping arm has a downwardly angled component 11. Gripping arm 8 is pivotally mounted at its rear end and lies with the rear edge of angle component at the front end on the periphery of new reel 3. A stop 12 is provided to prevent gripping arm 8 from dropping too low.

Since the outermost layer of the paper strip wound on reel 3 is already attached from the delivery side to the following layer over a part of the periphery, e.g., by adhesive, and since the paper strip lead or the protective strip lead lies free for a few centimeters and is not connected with the next layer at its free end, the paper and protective strip lead can bulge upward, as a result of these measures, upon rotation of reel 3 in the direction of the illustrated arrow and the stopping of the outermost layer against the rear free edge of the downwardly angled component 11, as shown in FIG. 2. This bulge is detected by a photoelectric mechanism or arrangement 13. A clamping punch 14, located below the gripping arm, is then operated to press its pressure contact part 15 against the rear side of downwardly angled component 11 clamping the bulge of the paper strip lead. The paper strip lead is thus clamped tightly.

Now, in tightly clamped state, the paper strip lead is pulled from reel 3, and the outside layer–is detached from the following layer and is guided along guide rail 7 to the splicing device. The guide rail is preferably a pneumatic linear assembly fed from the compressed air available from the cigarette making machine. An assembly of this type has the special advantage that its entire structural length can be quite small.

The suction of the lead of the paper strip of the new reel can be limited to suction of the protective strip. A time control can also be provided so that a certain further portion, e.g., 10 m., which may be damaged, likewise may be picked up by suction.

The stamping together of the two paper strips takes place in a bent lever press by a punch stamp 16 and a pressure stamp 17. As soon as the two paper strips are located between the two stamps in a rest state, the control can operate the bent lever press to press the two stamps together.

According to the present invention, the surface structure of the punch is configured in a special manner. Pyramids with rectangular bases are arranged in a uniform grid arrangement. The points of the pyramid of the punch stamp and the pressure stamp are arranged in a line transverse to the direction of movement of the paper, but are offset by half a pyramid length along the lengthwise direction of the paper movement. Stamping together of the paper strips is thus attained in planes in the direction of movement of the paper.

Figure 3:
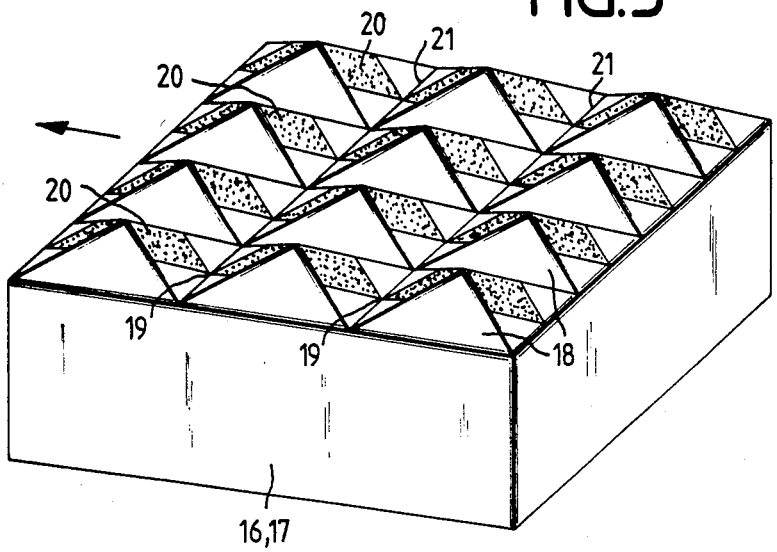
FIG. 3 is a perspective view of the surface of a stamping punch according to the present invention.

FIG. 3 shows the surface structure of the pattern of one of the stamps. The drawing shows a uniform arrangement of pyramids 18 with rectangular or four-concerned bases. The stamp, lying opposite the illustrated stamp, is offset by half a pyramid length in the direction of the arrow, corresponding to the direction of the movement of the paper. Therefore, its pyramid points fit between the pyramids of the opposite stamp at contact points 19. The side surfaces of the facing pyramids engage each other on dotted pressing surfaces 20. The paper strips are pressed together only on these surfaces 20 and mesh with each other at these points. It is clear from the drawing that neither in the direction of the arrow nor transverse to this direction is there any penetration of the surface by the pressing.

The surface pressure is reduced to a minimum along lines 21, so that the connection can easily bend along these lines, permitting guided meandering over several rolls. The required flexibility in this direction, however, is not as great as in transverse direction. With the arrangement according to the present invention, the stamping surface is arranged so that sufficient intermediate surfaces remain, transverse to the direction of paper movement, between stamping surfaces 20 to guarantee a sufficient flexibility along the transverse direction. This permits the paper strip stamped together in this manner to be wrapped around the tobacco rope without problem. Although the stamping obtained in this manner is of high strength, the bending resistance of the stamped connection is much less than that with a fluted profile or a nonuniform grid profile.

The points of pyramids 18 are preferably smoothed down on both sides of the punch stamp, and the surface pressures become smaller to the sides. The strength in the area of the stamping is therefore not abruptly increased, but rather increases uniformly. Because of this, the danger of tearing the paper on the stamping edge is greatly reduced.

The punch is narrower than the paper width so that the area of the paper strip where the strip is laid around the rope of tobacco is held free of pressure. For even greater strength of the stamp connection, it is possble to construct the pyramids asymmetrically, but in such a manner that the side surfaces of the pyramids, lying in the direction of pulling of the paper strip by the relevant pressure stamp, are configured steeper than the surfaces lying counter to the pulling direction. In the lengthwise section of a stamped paper strip connection, such a connection appears as an oblique sawtooth configuration.

The rhombic (diamond-shaped) stamp connection according to the present invention provides excellent strength with simultaneous high flexibility in both directions on the paper strip. The lateral flexibility is still greater than the axial flexibility of the paper strip.

The press presses both paper strips together with a force of about 5 t on a pressing surface of about 6 $cm^2$. The punch is supported against the pressing frame with cup springs for adjustment of the pressing force.

Figure 4:
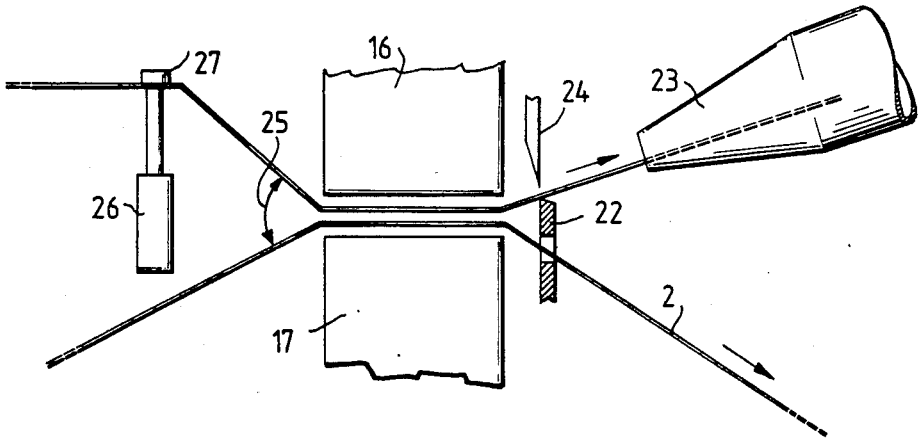
FIG. 4 is a diagrammatic side elevational view of the splicing mechanism of the machine of FIG. 1.

FIG. 4 shows the press from the side diagrammatically. Paper strips 2 and 22 lie parallel and one over the other between punch stamp 16 and pressure stamp 17. The end of strip 22, unwound from the new reel, is held by a suction device 23. This pulls paper strip 22 between top and bottom blades of cutting device 24. Paper strip 2 is threaded through the bottom blade of cutting device 24. On the opposite side of the stamping device, the angle 25 is produced by lifting paper strip 22 by means of a lifting device 26 and a holding lever or device 27, which lever lifts paper strip 22 by a vacuum pressure. A cutting device for trimming paper strip 2 can be provided directly behind the stamping device.

Directly following the stamping together of the two paper strips, the excess ends of the paper strips are trimmed by the respective cutting device. After opening the stamping device, the paper strips are connected in the correct manner, and can then be conveyed from there and fed into the rope making machine.

The procedure of the splicing process may be computer-controlled by a computer control device or by computer control of the machine itself. All movements are preferably powered pneumatically, since a pneutmatic pressure line is customarily already present on a cigarette machine. The device according to the present invention is preferably used on a cigarette making machine, but it can also, without any difficulty, be used on a filter making machine or for introduction of a lining paper to a filter making machine. Other possibilities of use may arise without further difficulty, e.g., in a driving-in machine.

While various embodiments have been chosen to illustrate the invention, it will be understood by those skilled in the art that various changes and modifications can be made therein without departing from the scope of the invention as defined in the appended claims.

What is claimed is:

1. A device for splicing a beginning portion of one paper strip winding to an end portion of another paper strip winding, comprising:

a new reel having a first paper strip wound thereon with a first layer fastened to a second layer and with a lead portion not connected with said second layer;

an off-winding reel having a second paper strip wound thereon with an end portion;

splicing means, mounted adjacent said off-winding reel, for receiving said first and second paper strips parallel to each other and for stamping said paper strips together, said splicing means including stamping surfaces having a uniform pattern of projections at right angles to each other such that stamping occurs essentially only in planes extending in a direction of paper strip movement;

a gripping means for picking up said lead portion and conveying said lead portion through said splicing means when open, said gripping means including an arm engaging said lead portion;

cutting means, mounted adjacent said splicing means, for trimming free ends of said paper strips;

suction means, mounted adjacent said splicing means, for receiving and pulling said lead portion through said splicing means; and control means for regulating operations of said reels and said means.

2. A device according to claim 1 wherein said arm of said gripping means comprises a downwardly angled component and is guided for movement in a lengthwise direction such that a back surface free edge of said angled component engages a free edge of said lead portion in a direction of new reel rotation and engagement of said angled component and said free edge causes a bulge in said lead portion; and said gripping means comprises photoelectric means for detecting said bulge, and clamping means for pressing said bulge against said angled component to pick up said lead portion and to guide said lead portion to said suction means.

3. A device according to claim 1 wherein said splicing means comprising a press having a punch stamp and a pressure stamp, said stamps being profiled to mesh together such that said paper strips are meshed when said stamps are pressed together.

4. A device according to claim 3 wherein said stamping surfaces comprise higher parts formed as pyramids with rectangular bases arranged uniformly lengthwise and crosswise of said paper strips, said pyramids of said punch stamp face and are laterally offset by only one-half pyramid length in the paper strip movement direction from said pyramids of said pressure stamp.

5. A device according to claim 1 wherein said paper strips are angularly separated from each other on each side of said splicing means for trimming the free ends of the paper strips.

6. A device according to claim 1 wherein said arm raises said first paper strip to an angle relative to said second paper strip between said new reel and said splicing means and directly behind said splicing means and said cutting means.

7. A device according to claim 6 wherein said arm comprised vacuum pressure means for raising said first paper strip.

8. A device according to claim 1 wherein said gripping means comprises compressed air-controlled linear drive means for sliding said gripping means.

9. A device according to claim 1 wherein a buffer store means is located downstream of said splicing means for receiving and storing paper strip; and said control means stops said reels during a stamping operation such that splicing occurs while said paper strips are at rest, increases off-winding reel rotational speed before reaching said end portion for a certain time period relative to pulling speed of machine driving paper strip to provide a certain length of paper strip in said buffer store means to be conveyed and used during the stamping operation, and accelerates said new reel following the stamping operation to provide another certain length of new paper strip in said buffer store means until new reel rotation speed corresponds to the pulling speed and the buffer store means is emptied.

10. A device according to claim 1 wherein said suction means pulls said lead portion of said first paper strip until an end of a protective strip of said first layer is detected.

11. A device according to claim 10 wherein a photoelectric means is located upstream of said splicing means for detecting said end of said protective strip.

12. A device according to claim 4 wherein said pyramids at both ends of each of said stamps in the paper strip movement direction are of reduced height.

13. A device according to claim 4 wherein said stamping surfaces extend for a distance transverse to the paper strip movement direction less than widths of said paper strips.

* * * * *